United States Patent [19]

Haytayan

[11] 4,122,904

[45] Oct. 31, 1978

[54] PNEUMATIC HAMMER DRIVER

[75] Inventor: Harry M. Haytayan, Lincoln, Mass.

[73] Assignee: Pneutek, Inc., Billerica, Mass.

[21] Appl. No.: 763,061

[22] Filed: Jan. 27, 1977

[51] Int. Cl.[2] ..... B25C 1/04; B25C 5/02

[52] U.S. Cl. ..... 173/15; 173/127; 173/139; 227/8; 227/130

[58] Field of Search ..... 173/13, 15, 127, 139; 227/4–8, 130; 277/187, 188 R, 188 A, 189; 151/57

[56] References Cited

U.S. PATENT DOCUMENTS

| | | | |
|---|---|---|---|
| 2,836,443 | 5/1958 | Farmer | 277/188 R X |
| 2,887,686 | 5/1959 | Wandel et al. | 173/139 X |
| 3,043,272 | 7/1962 | Wandel et al. | 227/130 X |
| 3,352,471 | 11/1967 | Fisher | 227/8 X |
| 3,512,454 | 5/1970 | Perkins | 227/130 UX |
| 3,601,007 | 8/1971 | Korth | 227/130 X |
| 3,708,096 | 1/1973 | Burke | 227/130 |
| 3,776,445 | 12/1973 | Pomeroy | 227/130 |
| 3,893,610 | 7/1975 | Smith | 227/130 X |
| 3,905,535 | 9/1975 | Novak et al. | 227/130 X |

FOREIGN PATENT DOCUMENTS

| | | | |
|---|---|---|---|
| 182,957 | 3/1918 | Canada | 151/57 |
| 386,138 | 9/1973 | U.S.S.R. | 173/15 |

*Primary Examiner*—Lawrence J. Staab

*Attorney, Agent, or Firm*—Schiller & Pandiscio

[57] ABSTRACT

An improved driver is provided wherein a pneumatically operated piston is slidably disposed in a cylinder which is adapted to vent to atmosphere through a port positioned adjacent the end wall of the cylinder. A piston cushion, anchored to the interior surface of the cylinder end wall, is configured to provide communication between the port and the air trapped under the piston when the latter makes contact with the cushion, as well as to avoid piston flexing when struck by the piston. The cylinder end wall is removable to provide access to the interior of the cylinder. A hammer, in the form of a shaft, is removably affixed to the piston in a manner that precludes leakage through the piston and extends through the cushion and the cylinder end wall. Sealing means which are accessible from the interior surface of the end wall provide sealing contact between the latter and the hammer.

12 Claims, 4 Drawing Figures

26
68
22
18
24
27
20
27
13
28
65
21
19
15
11
10
14
12
65
32
38
50
38
30
64
38
25
4
16
48
47
57
23
75
58
75
51
63
60
65
67
69
52
82
62
81
86
84
4
74
66
70
67
72
73
80
76
78
56
54
57
38
30
38
38
38

53
73
59
54
69
71
61
73
67
55
53

38
30
46
38
32
34
23
36
51
17
44
42
16

PNEUMATIC HAMMER DRIVER

BACKGROUND OF THE INVENTION

The present invention relates in general to new and improved drivers and in particular to a pneumatically operated driver for driving fasteners into hard structures such as steel plate or concrete, or steel plate overlying concrete.

Pneumatic drivers are well known in the art as shown for example by U.S. Pat. No. 3,952,398. In essence, a compressed gas is caused to act on a piston to drive a hammer against the work surface. Such devices have proven to embody advantages not found in more conventional drivers which employ explosive charges in place of a compressed gas. Among the salient advantages of pneumatic drivers over conventional drivers is the precision with which the stroke and the impact force of the hammer can be controlled.

Since they first came into use, pneumatic drivers have undergone a series of transformations. One of the significant improvements that have been made relates to a safety mechanism which prevents the driver from operating when the trigger is pressed unless the foot of the tool bears against a firm surface. The implementation of this safety feature requires the use of a special control valve selectively adapted to vent the interior of the driver cylinder to atmosphere, as disclosed in my copending U.S. patent application Ser. No. 637,571, filed Dec. 4, 1975 and now U.S. Pat. No. 4,040,554 for Pneumatic Apparatus.

In my application Ser. No. 637,571 such venting occurs through the piston cushion positioned on the interior surface of the end wall of the cylinder and, in part, through the end wall itself. The latter construction is subject to a number of disadvantages, not the least of which is the fact that it requires that the length of the driver be increased by substantially the entire length of the control valve. Such an increase in size not only makes the hand-held tool less convenient to use, but also adds to its weight. Further, such an arrangement requires relatively complex machining of the end wall, particularly if an angled conduit for the gas is employed as must be the case when the increase of the overall length of the driver is to be kept within bounds. This additional machining increases the cost of manufacture of the entire equipment.

Such costs are further increased by the necessity for providing an hermetic seal between the reciprocating hammer and the end plate. In my Application Ser. No. 637,571, the seal is positioned below the interior surface of the end plate and is no longer easily accessible once the piston cushion is installed. If the cushion is to be anchored in the end plate, it is necessary to increase the thickness of the latter in order to keep the seal below the cushion. Here again the length and weight of the driver must be increased to accomodate such an arrangement. In addition, the manufacture of the end plate as well as the installation of the seal, become relatively complex and expensive operations.

Prior art cushions in themselves incorporate certain disadvantages. It must be remembered that the purpose of the cushion in a hammer driver that is provided with a proper safety mechanism is to cushion the impact of the piston against the end wall. In the device disclosed in my copending application Ser. No. 637,571, such impact occurs only under certain conditions, specifically when the driver is used to drive fasteners into material that does not have the requisite hardness. Under normal operating conditions, i.e. when the driver is used with material of the proper hardness, the recoil which occurs when the work surface is struck disables the driver and arrests the power stroke of the piston at a predetermined spacing from the cylinder end wall. The aforesaid spacing is determined by the length of the hammer which is chosen to cause the piston, during normal operation, to make contact with the cushion without materially compressing the latter.

In prior art drivers the piston cushion is fastened to the interior surface of the end wall by means of a bonding agent. It has been observed that there is a tendency for the piston cushion to separate from the end wall upon continued use. It is believed that this may be due to the penetration of high pressure air between the cushion and the end wall. Alternatively it may be due to the inability of the bonding to withstand the compression of the cushion followed by an upward force of short duration exerted by the partial vacuum that is created as the piston withdraws. Partial or complete tearing of the bond may occur, which will result in a loss of operating efficiency and which may, in extreme cases, disable the driver.

Further, where venting to atmosphere occurs through a duct in the cushion and in the end wall, cushion wear will tend to occur at the entry to the duct due to the fact that the air in the cylinder is at a relatively high pressure, e.g. 150–175 psi. When the piston descends in its power stroke, wear tends to occur at the duct as the air in the cylinder is rapidly vented through this duct in the cushion. Further wear tends to occur when the piston ascends and air rushes in the opposite direction through the same duct and into the cylinder.

The problem of providing a cushion which will not separate from the end wall, which will wear well and facilitates provision for a sliding seal for the hammer, is compounded by the need to assure adequate venting of the cylinder. If the volume of air under the descending piston during the power stroke of the latter is not vented fast enough, a back pressure will be built up which will slow down the descent of the piston and detract from the force of the impact that can be delivered by the hammer. Thus, the efficiency of the driver may be impaired.

Some prior design efforts in this area have taken the form of using a cushion that covers only the central portion of the end wall of the cylindrical wall of the latter. Such a cushion has a number of disadvantages, primary among which is the damage that may be inflicted on the piston when it descends on the cushion at full force. Since the piston impacting on such a cushion is supported only by the relatively small area which coaxially surrounds the hammer, flexing of the non-supported piston portion may occur upon impact and this can result in permanent damage to the piston. A similar possibility of damage exists if the cushion is designed to be engaged by only a limited area of the piston at its periphery.

A further problem of prior art pneumatic drivers resides in the difficulty of providing access to all parts of the driver. For example, if damage to the piston cushion occurs, it is advantageous if the end plate is readily removable for purposes of repair of replacement. In many pneumatic drivers of the prior art such removal is carried out only with difficulty and in some devices the end plate is permanently fastened to the cylinder. In the latter case, access to the interior of the cylinder is poslsible only through the top portion of the cylinder, which requires the removal of the piston and of the blocking structure above the piston.

In any hammer driver which is in active service, the hammer requires service or replacement from time to time. In some pneumatic hammer drivers the hammer is fastened to the piston in a manner where both must be replaced if one becomes defective. In other prior art drivers the hammer extends through a bore which penetrates the piston and it is fastened to the latter by a nut threaded onto the hammer outside the cylinder. Quite apart from its propensity to loosen under vibration, this type of construction is also prone to leakage through the pistonpenetrating bore. Further, delays are often incurred during the re-assembly of such prior art equipment due to the difficulty of precisely aligning the hammer with the bore in the foot portion of the tool.

OBJECTS OF THE INVENTION

Accordingly, it is the primary object of the present invention to provide a pneumatic driver tool which is not subject to the foregoing disadvantages.

It is another object of the present invention to provide a pneumatic driver tool which is shorter and lighter than heretofore available apparatus of this type.

It is a further object of the present invention to provide a pneumatic driver tool which resists wear to a greater extent, which is less prone to breakdowns than heretofore available devices of this type, and in which all parts may be readily serviced.

It is still a further object of the present invention to provide a pneumatic driver tool which may be more economically manufactured.

These and other objects of the present invention, together with the features and advantages thereof, will become apparent from the following detailed specification when read in conjunction with the accompanying drawing.

DESCRIPTION OF THE INVENTION

Figures 1, 2, 3, 4:
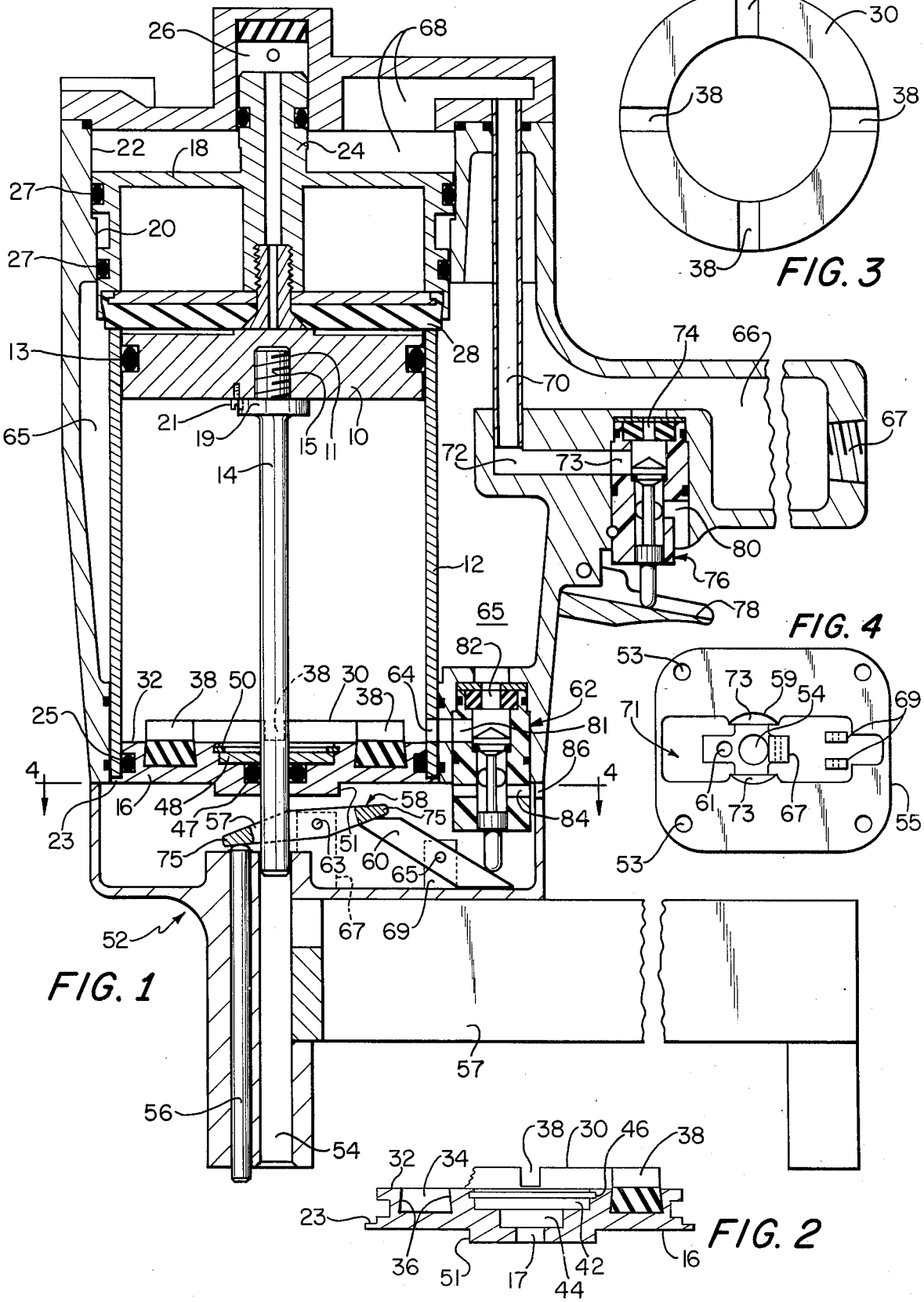
FIG. 1 illustrates a preferred embodiment of the invention.
FIG. 2 illustrates a detail of the apparatus of FIG. 1.
FIG. 3 illustrates in plan view the exemplary piston cushion used in the apparatus of FIG. 1.
FIG. 4 is a reduced-size view in schematic form of a portion of the apparatus taken at line 4—4 in FIG. 1.

With reference now to the drawing, FIG. 1 is a cross-sectional view of the pneumatic driver which forms the subject matter of the present invention. The illustrated tool is generally the same as the one disclosed in my copending application Ser. No. 637,571. As shown, a piston 10 is slidably disposed within a cylinder 12, a seal between the two parts being provided by an O-ring 13. A hammer 14 in the form of a rod is secured to the underside of piston 10 by means of a threaded end 15 which screws into a blind, internally threaded bore 11 in the piston. When fully inserted, hammer flange 19 abuts the underside of the piston. A set screw 21 is positioned in a recess of flange 19 and is threaded into the underside of the piston. In a preferred embodiment of the invention, the set screw is fastened to the piston with Loctite. The presence of the set screw prevents the hammer from loosening under vibration, while the hammer in turn holds the set screw in place by a reaction force.

Cylinder 12 is open at its upper end. The lower cylinder end is closed off by an end wall 16 having a central hole 17 which slidably accommodates hammer 14. End wall 16 also includes a lip 23 which is positioned beneath cylinder wall 12. An O-ring 25 is positioned in a peripheral groove of the end wall and makes sealing contact with the cylinder wall. A circular boss 51 is coaxially formed on the underside of end wall 16.

A poppet valve 18 is slidably disposed coaxial with the cylinder. As shown in FIG. 1, the lower portion of the poppet valve rides in a bore 20 while the upper portion, which has a slightly larger diameter, rides in a counterbore 22. An extension 24 of the poppet valve is slidably disposed in a cylindrical cavity 26. Suitably positioned O-rings 27 provide seals in each case with the conforming cylindrical walls. The lower end of poppet valve 18 terminates in a resilient cylindrical pad or cover 28. In the position illustrated in FIG. 1, cover 28 makes sealing contact with the open end of the cylinder 12.

The driver also comprises a separable foot portion 52 which is further illustrated, to reduced size, in FIG. 4. Foot portion 52 is removably fastened to the housing of the driver by means of holes 53 in a flange 55 of the foot portion through which bolts are adapted to thread into the driver housing. The foot portion includes a bore 54 which is adapted to accept hammer 14. A cavity 71 comprises a partial counterbore 59 which is terminated by a pair of steps 73. When the foot portion 52 is fastened to the driver housing, it abuts the exterior surface of end wall 16 and secures the latter in place. In the latter position, lip 23 of the end wall engages the bottom end face of cylinder 12 and boss 51 is seated in counterbore 59 and is engaged by steps 73. As a consequence, hammer 14 is precisely aligned with bore 54 and center hole 17.

Foot portion 52 also comprises a safety mechanism which includes shaft 56 positioned in a bore 61. The safety mechanism further includes linkage levers 58 and 60 which are pivotably disposed on pivot pins 63 and 65 respectively. Lever 58 comprises two parallel spaced arms, one of which is shown at 57, which are connected at their ends by cross-members 75. Pin 63 extends through arms 57 and is supported in a square boss 67 which is positioned within cavity 71 and which is integral with foot portion 52. Pin 65 is supported in a pair of square bosses 69 which are similarly integral with the foot portion and positioned inside cavity 71. Although not shown, it is to be understood that boss 67 is located between arms 57 while lever 60 is disposed between bosses 69. The safety mechanism further includes a control valve 62, the function of which will be explained below.

Foot 52 further carries a magazine 57 which communicates with bore 54. The magazine is adapted to store fasteners, e.g. nails or the like, that are to be driven into a work surface by hammer 14.

Cylinder 12 is surrounded by a reservoir 65 which communicates directly with a manifold 66 that is adapted to be connected to a source of high-pressure gas, such as air, through a coupling 67. The space above poppet valve 18 defines a chamber 68 which varies in size with the position of the poppet valve. Chamber 68 communicates with manifold 66 by way of a conduit 70, a passage 72 and through ports 73 and 74 of a control valve 76 when such valve is set to its normal position as shown in FIG. 1. When trigger 78 is squeezed, the movable valve element of valve 76 closes off port 74 and chamber 68 is vented to atmosphere by way of port 73 and a third port 80 of valve 76.

Cylinder 12 includes a port 64 extending through the cylindrical wall and positioned adjacent to and above end wall 16. The interior of cylinder 12 communicates with reservoir 65 by way of port 64 and via ports 81 and 82 of another control valve 62. Valve port 82 is open when valve 62 is set to its normal position as shown in FIG. 1. As shown, valve 62 also includes several ports 84 which communicate with several ports 86 (only one is shown) in the wall of the driver. In the position of valve 62 shown in FIG. 1, both of the latter ports are closed off from reservoir 65 and the interior of cylinder 12.

A resilient piston cushion 30 extends to a predetermined height above interior surface 32 of end wall 16. As best illustrated in FIG. 3, cushion 30 is configured as an annular ring. The cushion is anchored in an annular groove 34 coaxially formed in end plate 16, as best shown in FIG. 2. Groove 34 has tapering side walls 36 so as to present a wedge-shaped cross-section. As such, groove 34 is capable of firmly anchoring annular ring cushion 30, which is preferably molded into the groove and bonded during molding to end wall 16 which consists of a preformed metal plate.

As best seen from FIG. 3, annular ring cushion 30 includes a plurality of radial slots 38 of limited depth. In the illustrated preferred embodiment of the invention, only the portion of the annular ring that extends above interior surface 32 is slotted. It will also be seen that the dimensions of annular ring 30 are such that the radial distance between hammer 14 and ring 30 is substantially greater than the radial distance between ring 30 and the cylindrical wall of cylinder 12.

As illustrated in FIG. 2, a first counterbore 42 is machined into surface 32 and extends down into end wall 16. Counterbore 42 is coaxially positioned with respect to annular groove 34 and opens to surface 32. A second counterbore 44, having a slightly smaller diameter, communicates with counterbore 42 on one side and with central hole 17 on the other side. The cylindrical wall forming counterbore 42 further includes an annular groove 46.

As illustrated in FIG. 1, counterbore 44 contains a resilient rod seal 47 which makes sealing contact between reciprocating hammer 14 and end wall 16. Counterbore 42 accomodates a thrust washer 48 which serves to retain rod seal 47 in place and also to guide hammer 14 as it reciprocates. A snap ring 50 is disposed in annular groove 46 and serves to retain washer 48 in position.

The height to which cylinder port 64 extends above surface 32 is approximately 1/16 to ⅛ inch less than the height to which cushion 30 rises above the same surface. The dimensions of annular ring cushion 30 are such that port 64 remains free to communicate with the interior cylindrical space defined between piston 10 and interior end wall surface 32 and this remains true when the piston contacts the cushion. Specifically, port 64 remains free to communicate with the space surrounding cushion 30, as well as with the interior space encompassed by the annular cushion, by means of radial slots 38.

In operation, when control valve 76 is in the position shown in FIG. 1, air applied to manifold 66 through coupling 67 is transmitted to chamber 68 through valve port 74, port 73, passage 72 and conduit 70. The pressure so applied to the top surface of poppet valve 18 urges the latter in a downward direction such that resilient cover 28 of the poppet valve makes sealing contact with the open end of cylinder 12. Pressurized air also fills reservoir 65 (which is open to manifold 66) and exerts an upward force on the bottom part of poppet valve 18, i.e. on the portions that protrude beyond cylinder 12. However, since the effective surface area of the top portion of valve 18 is greater than the bottom portion, valve 18 remains in the position shown in FIG. 1. Pressurized air from reservoir 65 also enters the interior of cylinder 12 through valve port 82 and cylinder port 64. The force exerted by the air on the underside of the piston urges the latter to the upward position shown, i.e. into contact with resilient poppet valve cover 28.

If it is desired to drive a nail, a pneumatic driver is positioned over the designated spot on the work surface. The force bearing down on the tool causes the work surface to exert an upward force on shaft 56, which retracts within foot 52. The latter action is transmitted by way of linkage 58, 60 to cause valve 62 to be set to its other position. In the latter position, valve port 82 is closed and the interior of cylinder 12 is vented to atmosphere by way of cylinder port 64, valve ports 81 and 84 and ports 86 in the wall of the driver.

If trigger 78 is now pulled, valve 76 is set to its other position in which valve port 74 is closed and reservoir 68 is vented to atmosphere via ports 73 and 80. The pressure differential between the top and bottom portions of poppet valve 18 now shifts in favor of the bottom portion, so that the valve is caused to move upward and the pressurized air in reservoir 65 is applied to the top of piston 10. Piston 10 is thus impelled downward at a rapid rate to cause hammer 14 to be driven against the nail introduced into bore 54 from magazine 57. The latter action expels the nail from the bore and drives it into the work surface below.

As the descending hammer 14 strikes the work surface, the hammer driver is caused to recoil and foot 52 lifts off the work surface. When this occurs, shaft 56 is again able to protrude from foot 52 and valve 62 resumes the setting illustrated in FIG. 1. Pressurized air from reservoir 65 again enters the interior of cylinder 12 to urge the piston to its position at the open end of cylinder 12. After a nail is driven, trigger 78 is released and the setting of valve 76 shown in FIG. 1 is reestablished. When this occurs, poppet valve 18 is again moved downward into sealing contact with the open end of cylinder 12, whereupon the piston will be returned rapidly to its normal raised position ready for another nail-driving operation.

The length of hammer 14 is choosen so that, when the free end of the hammer shaft first touches the work surface, piston 10 is either positioned just short of cushion 30, or in contact with the cushion without compressing the latter. Since the height of port 64 extends to approximately 1/16 to ⅛ inch below the upper surface of cushion 30, it remains open for the full length of the power stroke of the hammer so that air under piston 10 can exhaust to atmosphere through the path established by ports 64, 84 and 86. This also applies to the volume of air inside the annular ring cushion, the trapping of such air by the descending piston being avoided by exhausting through slots 38. As a consequence, the descending piston encounters less air resistance during the power stroke and the hammer is able to deliver a more powerful blow. Further, wear on the cushion is minimized by the multi-channel distribution of the air flow provided by slots 38.

As previously noted, when the piston rises a suction force of short duration may be applied to cushion 30 which has a tendency to lift the latter off interior surface 32. In the present invention cushion 30 is molded into annular groove 34 which has a wedge-shaped cross-section that resists this upward force and hence the stability of the cushion is assured.

The above described apparatus presents significant advantages. Thus, the location and configuration of cushion 30 permit ready access to seal ring 47. Further, the particular arrangement of cushion 30 helps to avoid possible piston damage. As previously explained, the use of a coaxial cushion, close to the hammer and spaced from the cylindrical wall, presents problems in the event that the work piece encountered by hammer 14 is softer than prescribed. In the latter case, hammer 14 will be driven deeper than is normal and the stroke of piston 10 will be arrested by cushion 30. Due to the high impact speed and the force with which piston 10 is driven downward during the power stroke, it is possible, indeed likely, that the peripheral portions of the piston that overhang the central cushion will flex in the direction of surface 32 upon impact. Such impact may cause damage to the piston. Applicant's novel construction of a cushion in the form of an annular ring which balances the downward force of the piston, assures that flexing upon impact with the cushion and hence the danger of piston damage will be minimized.

The position of port 64 in the cylindrical wall of cylinder 12 adjacent end wall 16 makes it possible to position valve 62 at a point far higher than where it would be located if cylinder 12 were exhausted through cushion 30 and end wall 16. As a consequence, the tool can be considerably shortened with a resultant saving of weight and without any loss of performance. The location of port 64 also assures that high pressure air from reservoir 65 will reach the underside of the piston immediately after valve 62 is set to the position shown in FIG. 1, thereby assuring that the piston will move rapidly back to its raised position when the poppet valve is closed.

As previously explained, end plate 16 is held in place by foot portion 52. The foot portion may be readily removed so that the end plate can be detached from cylinder 12. With the end plate removed, access to seal 47 is provided through the center of the annular ring cushion 30 for servicing and replacement if necessary. Such replacement can be quickly carried out and requires only the removal of snap ring 50 and washer 48 in order to have access to the defective seal ring. Further, the counterbore which contains the washer and seal ring, as well as the shallow annular slot for holding the snap ring, can all be readily machined at low cost.

Access to the piston may be had either by removing the top portion of the hammer driver and extracting the poppet valve and the piston, or by removing end plate 16 and sliding the piston out through the bottom of the cylinder. In either case, hammer 14 is readily removable for servicing by loosening set screw 21 and unscrewing the hammer from the piston.

It will be clear that the invention described and illustrated herein lends itself to various modifications and substitutions. Various elastomeric materials may be used for the cushion and for the seals, such as rubber, polyurethane or the like. The cushion itself is not limited to an annular ring containing four slots. Any number of slots may be employed, consistent only with the requirement of proper air distribution during the downward stroke of piston 10 and with the primary cushion function of resiliently resisting the impact of the piston.

While port 64 has been shown as extending to approximately the same height as cushion 30, both distances being approximately equal to the spacing of piston 10 from the interior end wall surface when the free end of the hammer makes contact with the work surface, the invention is not so limited. It should be noted however, that if the height of the port exceeds the aforesaid spacing, the port will be partially covered by the descending piston and unable to perform its function efficiently.

In view of the foregoing discussion, it will be apparent that numerous modifications, substitutions and changes will now occur to those skilled in the art, all of which fall within the spirit and scope of the present invention as defined by the claims appended hereto.

What is claimed is:

1. A pneumatic driver for driving fasteners into a work surface comprising:

a cylinder including an end wall closing off one end of said cylinder, said end wall including (a) an interior surface normal to the axis of said cylinder, (b) a hole, and (c) a coaxial cavity intersecting said interior surface and open to the interior of said cylinder, said cavity being defined by inner and outer walls spaced respectively from said hole and said cylinder and the cross-section of the cavity widening with increasing depth from said interior surface;

a piston slidably disposed in said cylinder;

a resilient piston cushion molded into said cavity and spaced from the cylindrical wall of said cylinder, said cushion extending to a predetermined height above said interior surface;

a port extending through said cylindrical wall adjacent said end wall and being positioned clear of said cushion;

a foot portion positioned beyond said end wall, said foot portion including a bore coaxial with said hole and said cylinder and adapted to receive successive ones of said fasteners; and a hammer in the form of a shaft coaxially connected to said piston, said hammer extending through said hole with said cushion coaxially spaced from said hammer, said hammer further extending into said bore and being adapted to drive said fasteners successively into said work surface, the length of said hammer being chosen to position said piston immediately adjacent said cushion when the free end of said hammer makes contact with said work surface.

2. The apparatus of claim 1 wherein said cushion comprises is spaced from said hammer a distance at least equal to the height of said cushion.

3. The apparatus of claim 1 wherein said cylinder is open at its other end; said apparatus further comprising:

a poppet valve slidably disposed beyond said open end coaxial with said cylinder;

a chamber;

a reservoir hermetically isolated from said chamber by said slidable poppet valve;

a manifold for introducing a gas under pressure, said manifold communicating directly with said reservoir;

a first control valve normally set in a first position adapted to provide communication between said chamber and said manifold, said poppet valve being urged into sealing contact with said open cylinder end when said first control valve is in said first position;

means for selectively setting said first control valve to a second position adapted to vent said chamber to atmosphere;

a second control valve normally set to a first position adapted to provide communication through said port between said cylinder and said reservoir, said piston being urged toward said open cylinder end and into contact with said poppet valve when said second control valve is in said first position;

and means for selectively setting said second control valve to a second position adapted to vent said cylinder to atmosphere, said piston being enabled to move toward said end wall when said second control valve is in said second position.

4. The apparatus of claim 3 wherein said means for setting said first control valve comprises a trigger mechanism selectively adapted to operate said driver, and wherein said means for setting said second control valve comprises a safety mechanism adapted to render said driver operative only when said foot portion firmly bears against said work surface.

5. The apparatus of claim 1 wherein said cushion is an annular ring and includes a plurality of radial slots limited in depth substantially to the portion of said cushion that extends above said interior surface, each of said slots being in communication with said port.

6. The apparatus of claim 1 wherein the height of said cushion exceeds the distance by which said port extends above said interior surface.

7. The apparatus of claim 1 wherein said cushion is in the form of an annular ring, and the radial distance between said hammer and said annular ring exceeds the radial distance between said annular ring and said cylinder.

8. The apparatus of claim 1 and further comprising:

a first counterbore coaxially disposed in said end wall radially inward of said cavity and opening onto said interior surface;

an annular groove formed in the cylindrical wall of said first counterbore;

a second counterbore disposed below said first counterbore in said end wall and having a diameter smaller than said first counterbore;

a rod seal disposed in said second counterbore adapted to make hermetic sealing contact between said hammer and said end wall;

a thrust washer disposed in said first counterbore adapted to secure said rod seal against movement and guide said hammer; and a snap ring disposed in said last-recited annular groove adapted to retain said washer in said first counterbore.

9. A pneumatic driver comprising:

a housing having a foot section with a bore;

a cylinder mounted within said housing, said cylinder having (1) a cylindrical wall that extends parallel to said bore and (2) an end wall with an interior surface at a right angle to said bore and the axis of said cylinder;

a pneumatically operated piston slidably disposed within said cylinder;

a hammer having substantially the form of a shaft connected to said piston and slidably extending through a hole in said end wall into said bore, the length of said hammer at least being long enough for said piston to be positioned at a predetermined spacing from said interior surface when the free end of said hammer is at the outer end of said bore in position to make contact with a work surface exterior of said driver;

a resilient annular piston cushion molded in an annular cavity in said end wall coaxial with said hammer, said annular cavity being wedge-shaped in cross-section and intersecting said interior surface, said annular cavity being defined by inner and outer walls which are spaced respectively from the hole in said end wall and said cylindrical wall, and said cushion being radially spaced from said hammer and from the cylindrical wall of said cylinder;

said cushion extending above said interior surface to a height substantially equal to or less than said spacing and having slots on the side thereof facing said piston for providing communication between the space extending from said cushion to said hammer and the space extending from said cushion to said cylindrical wall;

a port disposed in said cylindrical wall at least partially positioned within said spacing for permitting air to move into and out of said cylinder as said piston and hammer move back and forth in said cylinder;

a resilient sealing member disposed in a recess in said end wall and surrounding and slidably engaging said hammer; and means attached to said end wall for retaining said sealing member in said recess.

10. A pneumatic driver comprising:

a pneumatically operated piston slidably disposed within a cylinder;

said cylinder including an end wall having an interior surface normal to the axis of said cylinder;

a hole in said end wall;

a hammer having substantially the form of a shaft connected to said piston and slidably extending through said hole in said end wall of said cylinder, the length of said hammer being chosen to position said piston at a predetermined spacing from said interior surface when the free end of said hammer makes contact with a work surface;

said end wall having a coaxial cavity open to the interior of said cylinder only, said cavity being defined by inner and outer walls spaced respectively from said hole and said cylinder, and the cross-section of said cavity widening with increasing depth from said interior surface;

a piston cushion molded into said cavity, said cushion being coaxial with said hammer and radially spaced from said hammer and from the cylindrical wall of said cylinder;

said cushion extending above said interior surface to a height substantially equal to or less than said spacing; and a port disposed in said cylindrical wall at least partially positioned within said spacing.

11. A pneumatic driver comprising:

a pneumatically operated piston slidably disposed within a cylinder;

said cylinder including an end wall having an interior surface normal to the axis of said cylinder;

a hammer having substantially the form of a shaft connected to said piston and slidably extending through said end wall of said cylinder, the length of said hammer being chosen to position said piston at a predetermined spacing from said interior surface when the free end of said hammer makes contact with a work surface;

a piston cushion anchored to said end wall coaxial with said hammer and radially spaced from said hammer and from the cylindrical wall of said cylinder;

said cushion extending above said interior surface to a height substantially equal to or less than said spacing, said cushion comprising an annular ring coaxially spaced from said hammer a distance at least equal to the height of said cushion;

a port disposed in said cylindrical wall at least partially positioned within said spacing;

a counterbore in said end wall open to the interior of said cylinder and coaxially disposed within and spaced from the inner edge of said annular ring; and means disposed in said counterbore to make hermetic sealing contact between said hammer and said end wall.

12. A pneumatic driver comprising:

a cylinder including an end wall having an interior surface normal to the axis of said cylinder;

a pneumatically operated piston slidably disposed within said cylinder, said piston having an internally threaded, coaxial blind bore opening onto the exterior surface of said piston;

a hammer having substantially the form of a shaft slidably extending through said end wall of said cylinder, said hammer terminating at one end in a threaded portion and having a flange adjacent said threaded portion, said threaded portion being engaged with said blind bore to a depth where said flange abuts said exterior piston surface; said flange including a recess;

a set screw positioned in said recess and screwed into said piston for preventing the loosening of said hammer in said blind bore under the action of vibration, the length of said hammer being chosen to position said piston at a predetermined spacing from said interior surface when the free end of said hammer makes contact with a work surface;

a piston cushion anchored to said end wall coaxial with said hammer and radially spaced from said hammer and from the cylindrical wall of said cylinder;

said cushion extending above said interior surface to a height substantially equal to or less than said spacing; and a port disposed in said cylindrical wall at least partially positioned within said spacing.

* * * * *

UNITED STATES PATENT AND TRADEMARK OFFICE

CERTIFICATE OF CORRECTION

PATENT NO. : 4122904

DATED : October 31, 1978

INVENTOR(S) : Harry M. Haytayan

It is certified that error appears in the above-identified patent and that said Letters Patent are hereby corrected as shown below:

Column 8, claim 2, line 53, the word "comprises" should be deleted.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*